US008573135B2

(12) United States Patent
Le Monnier

(10) Patent No.: US 8,573,135 B2
(45) Date of Patent: Nov. 5, 2013

(54) LOAD SUPPORT DEVICE MADE OF CARDBOARD MATERIAL THAT CAN WITHSTAND PRESSURE FORCES EXERTED THEREON

(76) Inventor: Jacques Le Monnier, Nuelles (FR)

( * ) Notice: Subject to any disclaimer, the term of this patent is extended or adjusted under 35 U.S.C. 154(b) by 0 days.

(21) Appl. No.: 13/640,630

(22) PCT Filed: Apr. 12, 2011

(86) PCT No.: PCT/IB2011/000808
§ 371 (c)(1),
(2), (4) Date: Oct. 11, 2012

(87) PCT Pub. No.: WO2011/128758
PCT Pub. Date: Oct. 20, 2011

(65) Prior Publication Data

US 2013/0032065 A1 Feb. 7, 2013

(30) Foreign Application Priority Data

Apr. 13, 2010 (FR) ..... 10 01548
Jun. 11, 2010 (FR) ..... 10 02482
Nov. 26, 2010 (FR) ..... 10 04645

(51) Int. Cl.
*B65D 19/00* (2006.01)

(52) U.S. Cl.
USPC ..... 108/51.3

(58) Field of Classification Search
USPC ..... 108/51.11, 51.3, 56.1; 248/346.02
See application file for complete search history.

(56) References Cited

U.S. PATENT DOCUMENTS

| | | | | | |
|---|---|---|---|---|---|
| 2,957,668 | A | * | 10/1960 | Norquist et al. | 108/51.3 |
| 3,952,672 | A | * | 4/1976 | Gordon et al. | 108/51.3 |
| 4,102,525 | A | * | 7/1978 | Albano | 108/51.3 |
| 4,475,703 | A | * | 10/1984 | Nordgren | 108/51.3 |
| 5,176,090 | A | * | 1/1993 | Roberts et al. | 108/51.3 |
| 5,285,732 | A | * | 2/1994 | Gottlieb | 108/51.3 |
| RE35,131 | E | * | 12/1995 | Youell et al. | 108/51.3 |
| 5,483,875 | A | * | 1/1996 | Turecek et al. | 108/51.3 |
| 5,528,995 | A | * | 6/1996 | Lim | 108/56.1 |

(Continued)

FOREIGN PATENT DOCUMENTS

| | | |
|---|---|---|
| DE | 296 06 874 | 7/1996 |
| FR | 1 002 482 | 3/1952 |

(Continued)

OTHER PUBLICATIONS

Form PCT/ISA/210 issued in PCT/IB2011/000808.

*Primary Examiner* — Jose V Chen
(74) *Attorney, Agent, or Firm* — Greenblum & Bernstein, P.L.C.

(57) ABSTRACT

Load support device of cardboard material. The load support device includes at least one block element having a polygonal shape, at least two vertical walls, a horizontal base, an upper load receiving surface, and at least one locking fold arranged in at least one corner of the block element. The locking fold is formed by at least two lateral vertical contact sections of the block element such that the block element, in an area of the locking fold, provides load support and the locking fold functions as reinforcement. A reinforcing locking wedge element made of a same material as said at least one block element is utilized and includes a base and four portions. At least one of the four portions is structured and arranged to strengthen and lock a position of the at least one locking fold.

20 Claims, 14 Drawing Sheets

(56) References Cited

U.S. PATENT DOCUMENTS

| | | | | |
|---|---|---|---|---|
| 5,592,885 | A * | 1/1997 | Young et al. | 108/51.3 |
| 5,713,289 | A * | 2/1998 | Model | 108/56.3 |
| 8,146,515 | B2 * | 4/2012 | Trickett | 108/55.5 |
| 2003/0000432 | A1 * | 1/2003 | Crevillen Pastor | 108/51.3 |
| 2005/0126449 | A1 | 6/2005 | Horiuchi | |

FOREIGN PATENT DOCUMENTS

| | | |
|---|---|---|
| FR | 2 703 327 | 10/1994 |
| FR | 2 725 179 | 4/1996 |
| GB | 779 014 | 7/1957 |
| GB | 1 433 722 | 4/1976 |

* cited by examiner

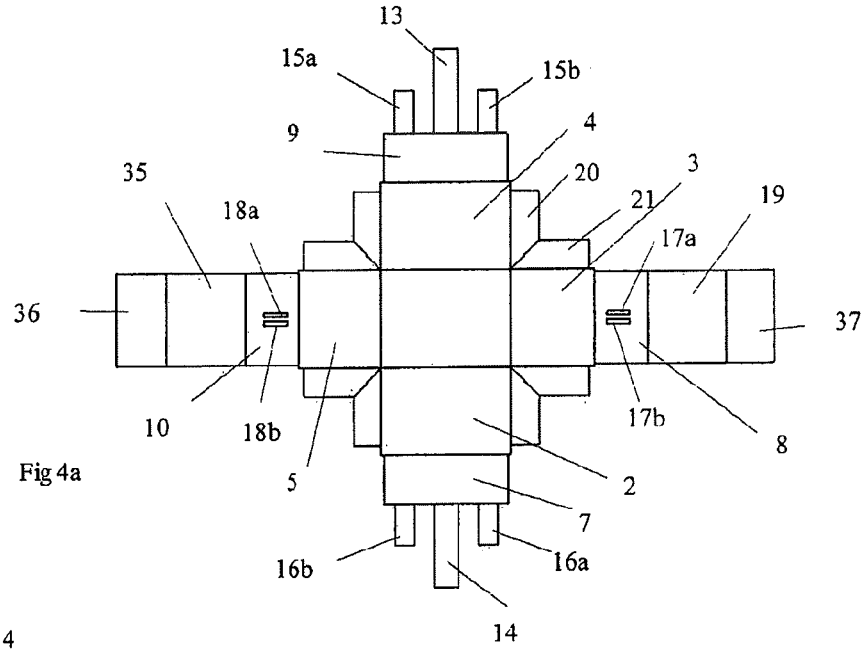
Fig 4a
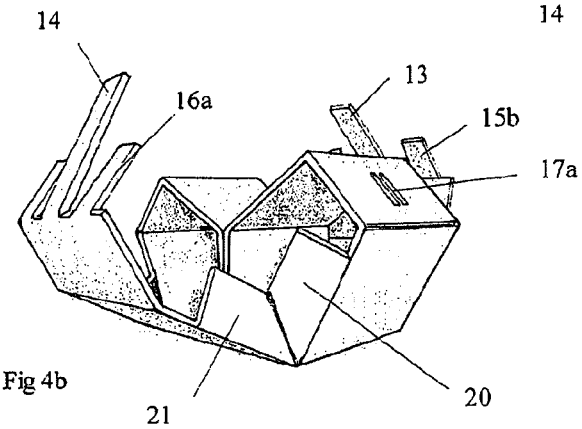
Fig 4b
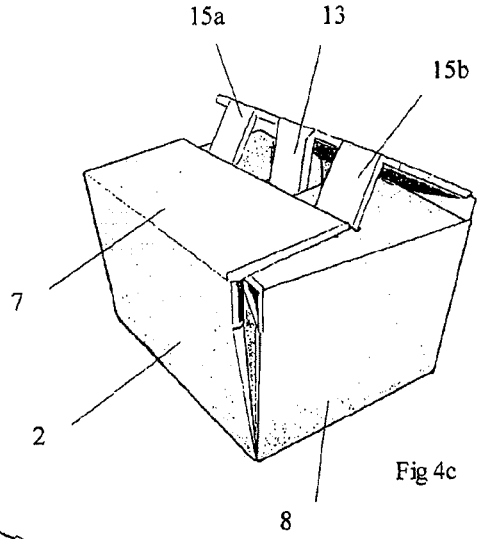
Fig 4c
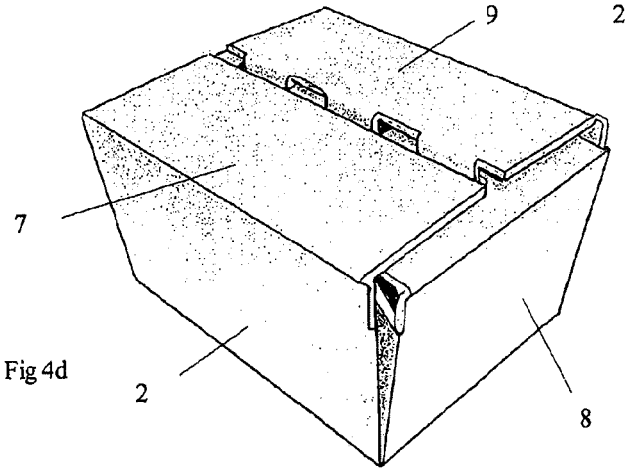
Fig 4d
FIG. 4

Fig 14a
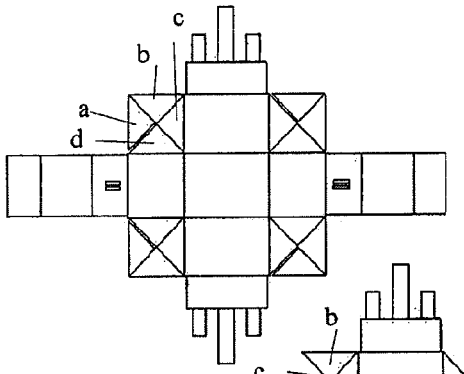
Fig 14b
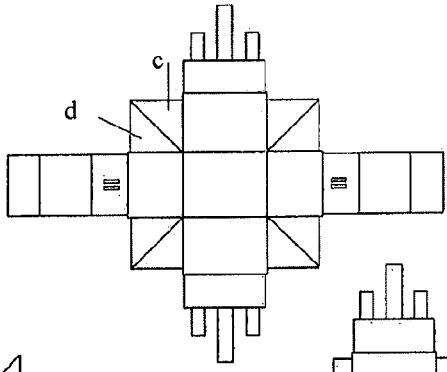
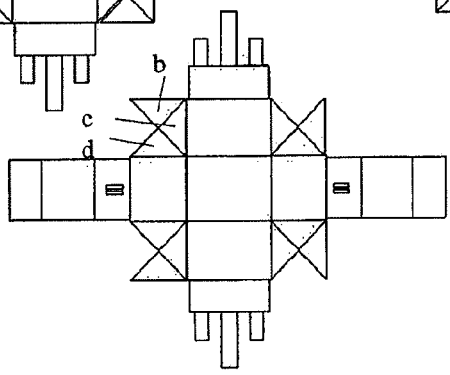
Fig 14c
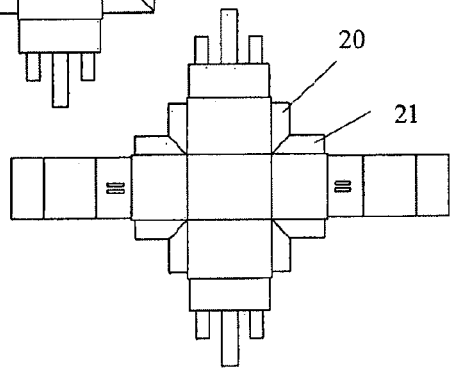
Fig 14d
FIG. 14

LOAD SUPPORT DEVICE MADE OF CARDBOARD MATERIAL THAT CAN WITHSTAND PRESSURE FORCES EXERTED THEREON

TECHNICAL FIELD OF THE INVENTION

The present invention relates to the technical field of load support devices, in other words a device able to withstand pressure forces exerted laterally, more particularly vertically, or along other directions, as explained herein under, etc. such as, for example the weight of a load placed or fixed on said support device (in the preferred case of a constraint or a load exerted vertically).

STATE OF THE ART

Devices of the pallet type are known which are produced by assembling wood parts (mainly) fixed by nails, glue, staples, screws, etc. . . . and the like.

Such devices make it possible to handle the load which shall be placed thereon in order, for example, to move it.

Such devices are made up of a wooden plate under which several rows of wooden support elements shall be fixed. Such support elements are spaced to make their handling possible and to enable the forks of machines such as so-called "fork-lift trucks" or "pallet trucks" to go between the elements in order to enable the gripping and handling of the pallet/load support device assembly.

The above is well known to the persons skilled in the art and shall not be further detailed therein.

One of the drawbacks of wood pallet devices lies in that they cannot be recycled. As a matter of fact, used pallets which have been damaged over time and utilizations shall have to be burnt or stored by the user.

Besides, in some regions of the world, wood is extremely rare and the fact that some countries import wood for creating wood pallets is absurd since this is expensive and, from and ecological point of view, wood thus cannot be used for more useful purposes. Such pallets are also polluting since they are more and more often treated with chemical products killing the parasites and germs they contain before travelling through regions and countries. The pollutants are sometimes very powerful and contaminate vegetation. When broken, wooden pallets emit particles and create pieces which can be harmful to health, such as splinters of treated woods going into the hands.

Another drawback lies in that wooden pallets are relatively heavy, with a weight between approximately 10 and 30 kg, and a handling agent cannot lift more than 200 kg of (empty) pallets per day without facing possible detrimental effects on his/her health, if he/she does not use a truck.

On the contrary, such pallets can receive very heavy loads creating vertical constraints.

"Vertical" means the direction of the earth's gravity.

Many documents are also known which more particularly aim at substituting cardboard materials for wood (with the aim of remedying the above mentioned drawbacks). As a matter of fact, the persons skilled in the art have considered creating cardboard elements whereon a plate element is positioned, with the assembly thus forming the pallet. Such elements are produced and assembled with glue or other adhesive elements in order to fix walls together.

"Cardboard" refers to well-known products produced from low quality cellulose pulp on paper making machines or the like. The word "cardboard" is also well known.

Unfortunately, even though they show some resistance to loads, these products are not satisfactory as compared to conventional wooden pallets, more particularly as regards solidity, resistance to heavy loads, and handling.

As a matter of fact, accidental contacts or heavy loads literally "burst" or shear the cardboard support(s).

Besides, such "cardboard" pallets are assembled by hot gluing, of the thermofusible type, various elements containing solvents. From an ecological point of view, this is not satisfactory and it is expensive.

Nowadays, wooden pallets are still widely and mainly used everywhere in the world, which demonstrates that the offered alternative solutions have not been considered as satisfactory to the persons skilled in the art, in spite of the drawbacks known for decades.

The concerned industrial sector thus turned away from the "cardboard" industry for load pallets, after unsuccessful or not successfully marketable tries.

The applicant has nonetheless decided to resume studies connected with the "cardboard" sector, in spite of the unfavorable prejudice mentioned, and filed an application for a patent FR 1002482 relating to a folding system for locking purposes or self-locking surfaces.

This patent application is limited to the field of boxes, such as shoe boxes, trays, in other words without any special solidity.

This had not been considered at all in the prior art.

In this general field, the patent GB 1 433 722 is known which discloses a folding system, which makes it possible to substitute said folding system for glue.

The prior system is certainly a praiseworthy attempt, but it is extremely limited in that very thin cardboard, preferably of the solid fiberboard or single or single micro wall corrugated board must be used since, if large walls or very thick cardboards are used, the folding system takes more and more space and the box can no longer be used, since the folding system, because of its rigidity, can no longer be turned down against a wall. The higher the box, the bulkier the folding system. The useful volume is obstructed by the folding systems.

Eventually, the GB patent considers no other solution than the production of boxes and mentions no load distribution capacity on the doubly reinforced cutting edges.

Such document, limited to the production of "boxes" with large bottoms and low wall height, thus contributes to reinforcing the prejudice of the prior art.

The Applicant has looked for other possible applications, within the scope of his/her research on blocks, side-members or pallets, and could, quite surprisingly, demonstrate that, if such properly adapted "locking fold" is now used to form blocks, the characteristics of solidity, resistance and flexibility given to the block are very significantly reinforced, and that the latter can thus support very heavy loads.

One of the Applicant's credits lies in his/her search for an efficient and neat solution in the "cardboard" industry.

TECHNICAL PROBLEM MET

A real need thus exists for the creation of a heavy load support device (or a fortiori low or average, but more particularly very heavy loads), which is not expensive, at least as strong as the existing devices (stronger, if possible), which can be recycled, thus preferably limiting, or more preferably avoiding the use of glue. Said device shall have to be as light as possible to be handled as easily as possible.

The object of the present invention is thus to create an environment-friendly load support device guaranteeing the best solidity/lightness ratio for a low cost.

DESCRIPTION OF THE INVENTION

The present invention thus relates to a load support device made up of at least one support "block". "Block" means any element having a substantially square, rectangular or the like shape, in other words having a triangular, trapezoidal cross-section, or side-member etc. . . . and more particularly having (in the NON limiting event of a cube or the like, which are the favorite shapes) four vertical walls, and a horizontal base connecting the 4 walls.

"Load support" element here means any element intended to support a load placed "thereon", in other words exerting a constraint in the "vertical" direction on the face or upper surface thereof and more particularly means pallets, etc.

The constraint may, in certain cases, be exerted in the vertical direction, but on the lower surface, or even on both upper and lower faces, for example if the load is placed under the block or the pallet, or even if the block or the pallet is placed vertically between two loads, for example in order to create a vertical interval between two or more loads.

Similarly, the constraint may also be exerted on a lateral face of the block in the event of either a 90° rotation of the block, or a production arrangement which shall easily be understood by the persons skilled in the art.

In the following, the case of a "vertical" constraint shall be considered, which shall include all the other cases, because of an obvious technical equivalence, such as for example lateral pressure.

Figures 3, 3A, 3B, 3C, 3D:
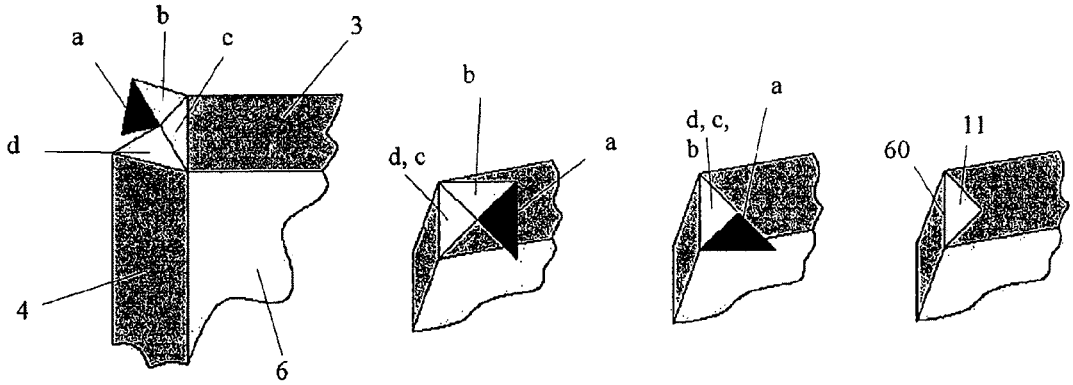

FIG. 3, which includes FIGS. 3*a* to 3*d*, describes a non limiting preferred embodiment of the "locking fold".

FIG. 4, which includes FIGS. 4*a* to 4*d*, describes the embodiment of an alternative block, which is also preferred, and probably the "best" embodiment so far.

Figure 5:
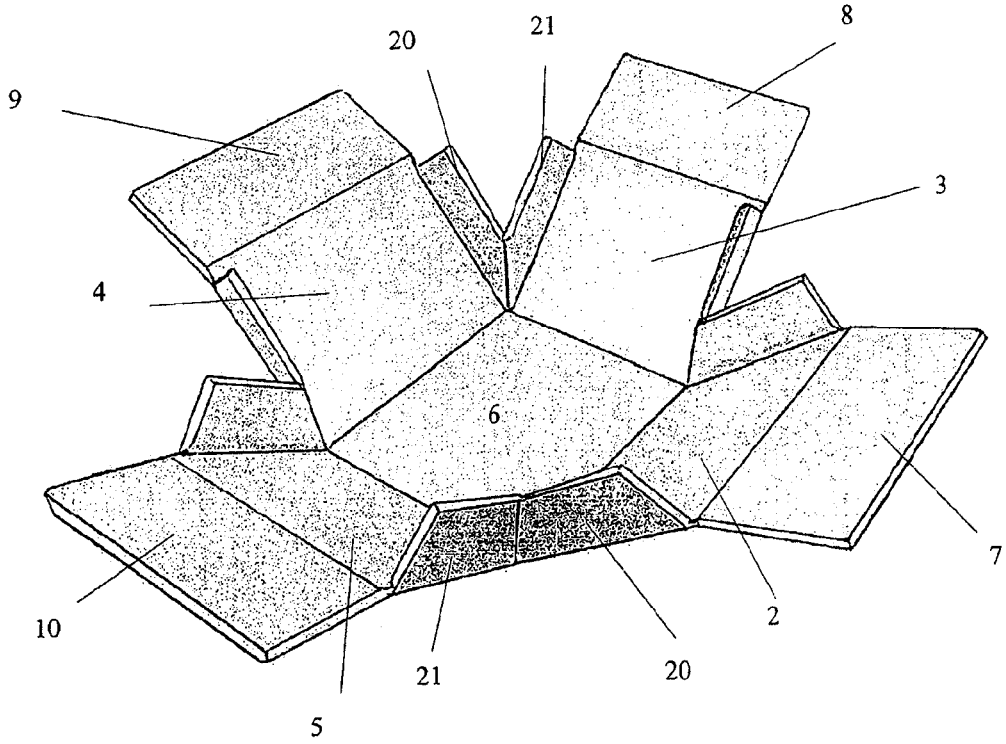

FIG. 5 describes an embodiment of a block with a locking fold 11 made of two vertical lateral contact sections 20, 21.

Figure 6:
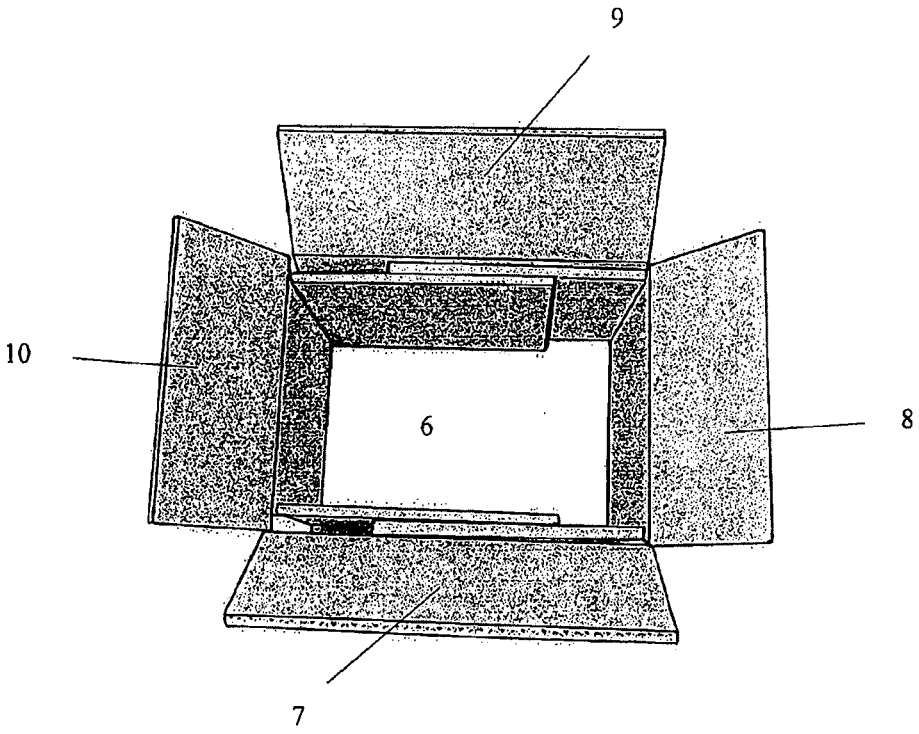

FIG. 6 describes an embodiment of a block according to a less preferred embodiment.

Figure 7:
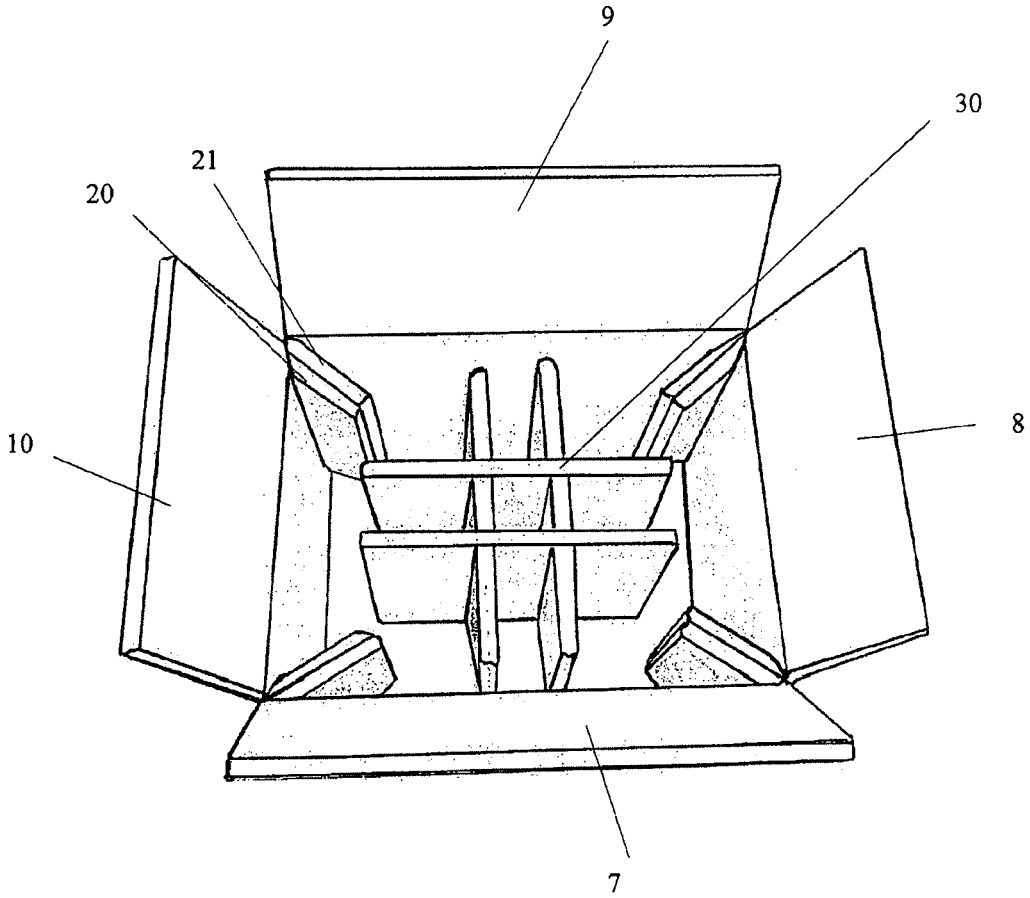

FIG. 7 shows a block with an inner reinforcing device positioned in the centre of the block.

Figure 8:
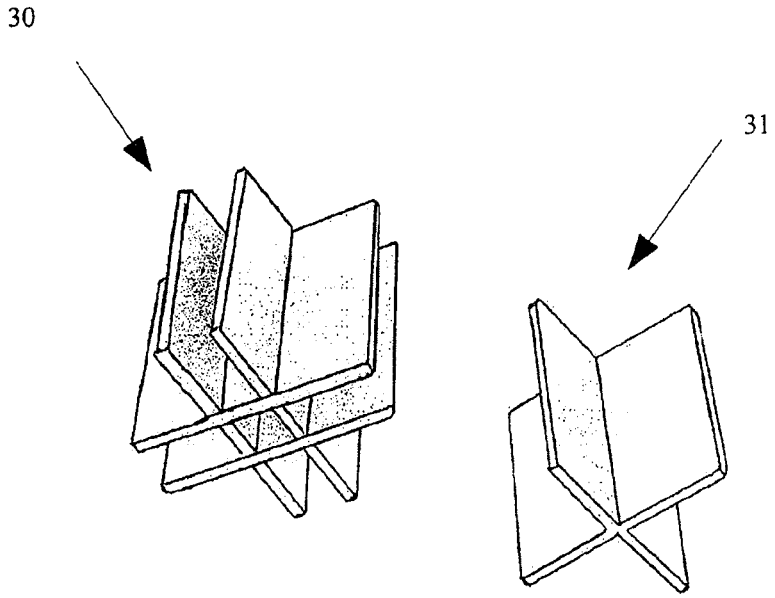

FIG. 8, which includes FIGS. 8*a* and 8*b*, shows non limiting examples of inner reinforcing elements.

Figure 9:
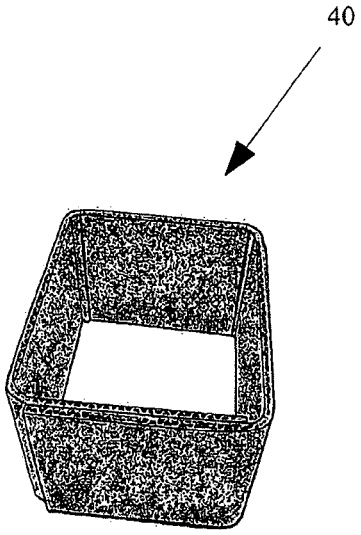

FIG. 9 shows a non limiting example of an outer reinforcing element.

Figure 10:
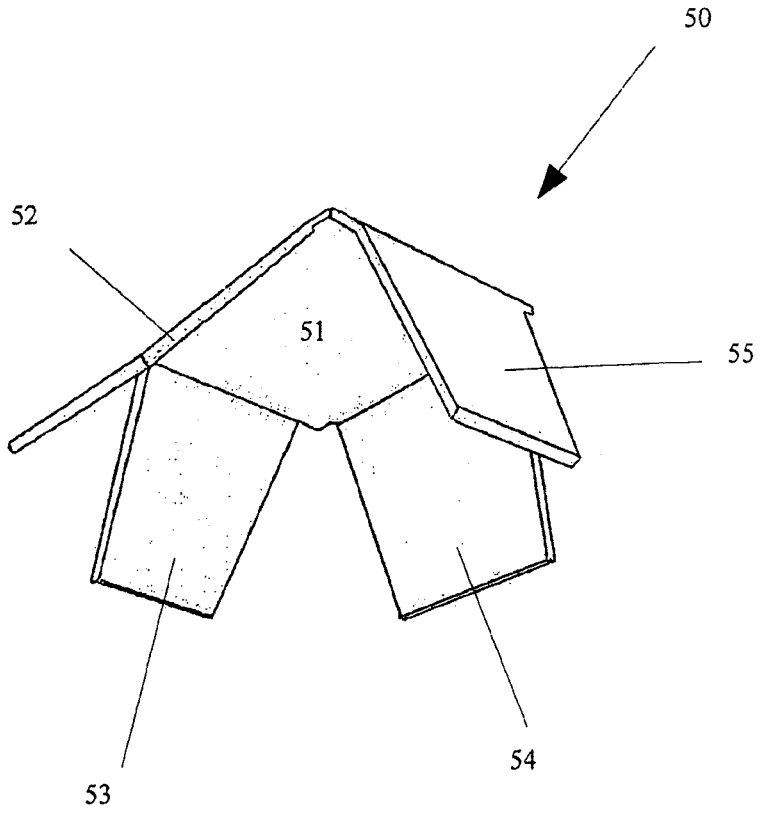

FIG. 10 shows a non limiting example of a "locking wedge".

Figure 11:
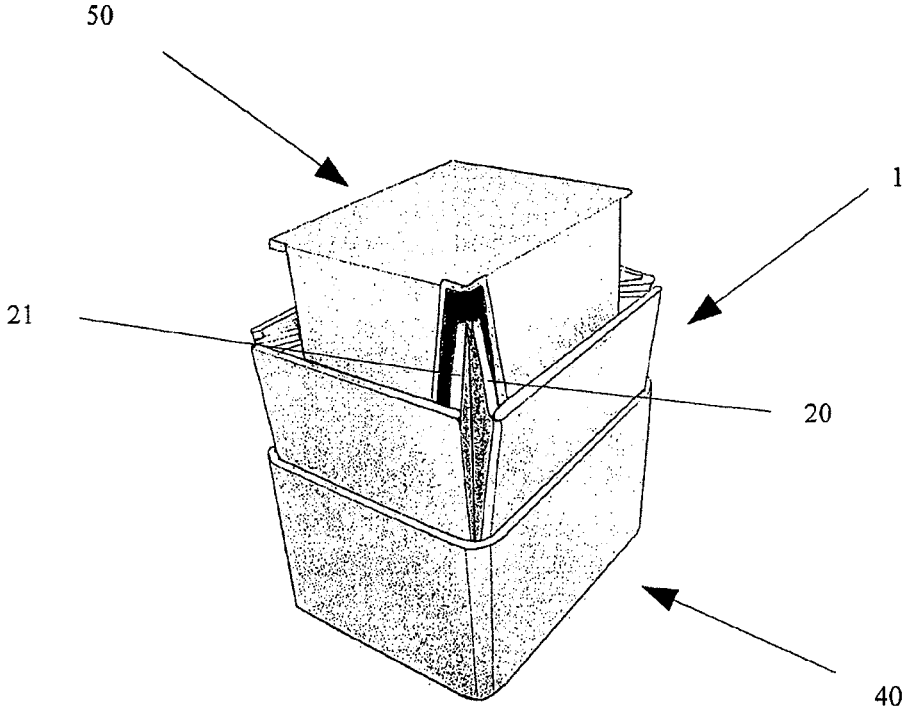

FIG. 11 shows the block, the outer reinforcing element and the locking wedge element, according to the preferred embodiment.

Figure 12:
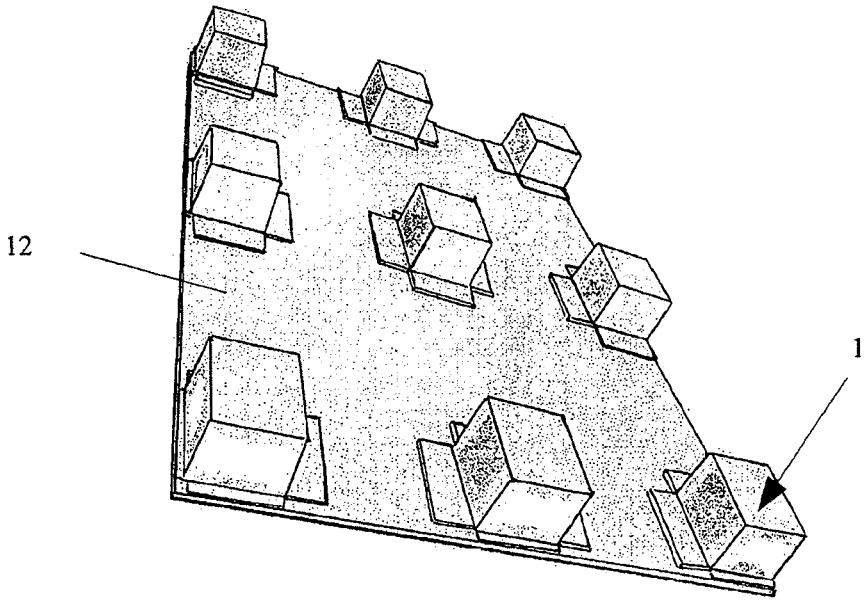

FIG. 12 shows a bottom view of a load support device containing 9 blocks produced according to the present invention.

Figure 13:
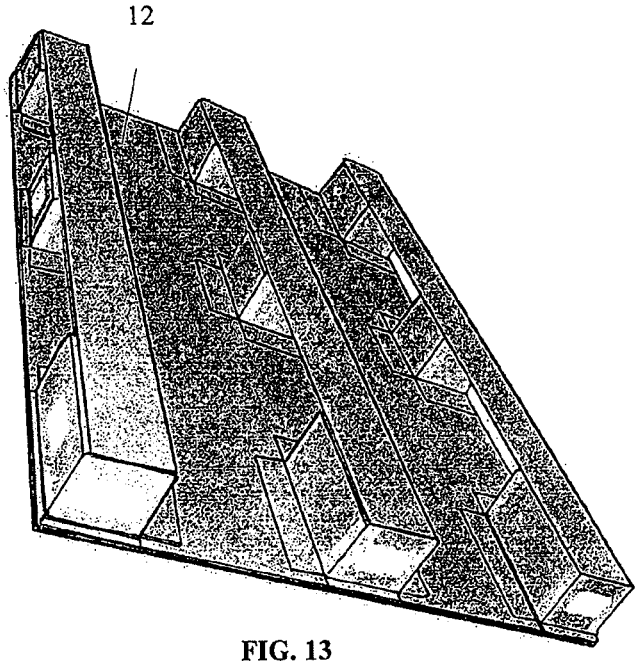

FIG. 13 shows a bottom view of another load support device containing 9 blocks produced according to the present invention and provided with pads or "skis".

FIG. 14, which includes FIGS. 14*a* to 14*d*, shows the block of FIG. 4 with various types of locking folds (with 4 triangles, 3 triangles, 2 triangles, two contact sections).

Figure 15:
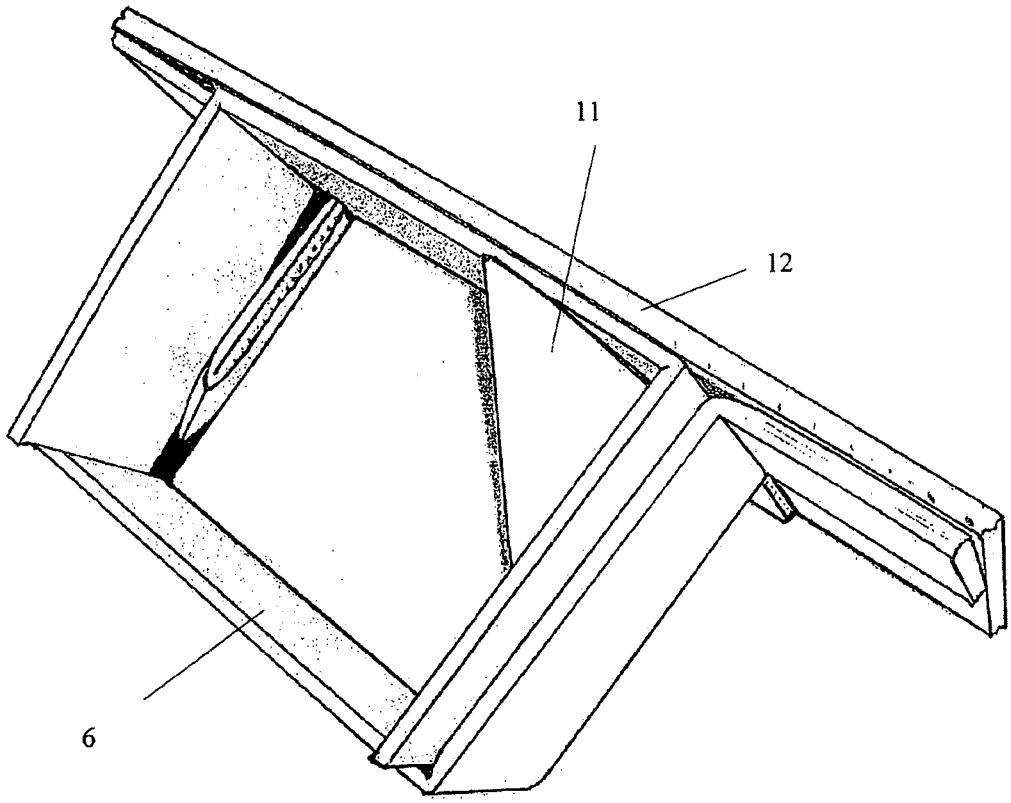

FIG. 15 shows the locking folds coming into contact with the upper portion of the block or with the upper plate.

Figure 1:
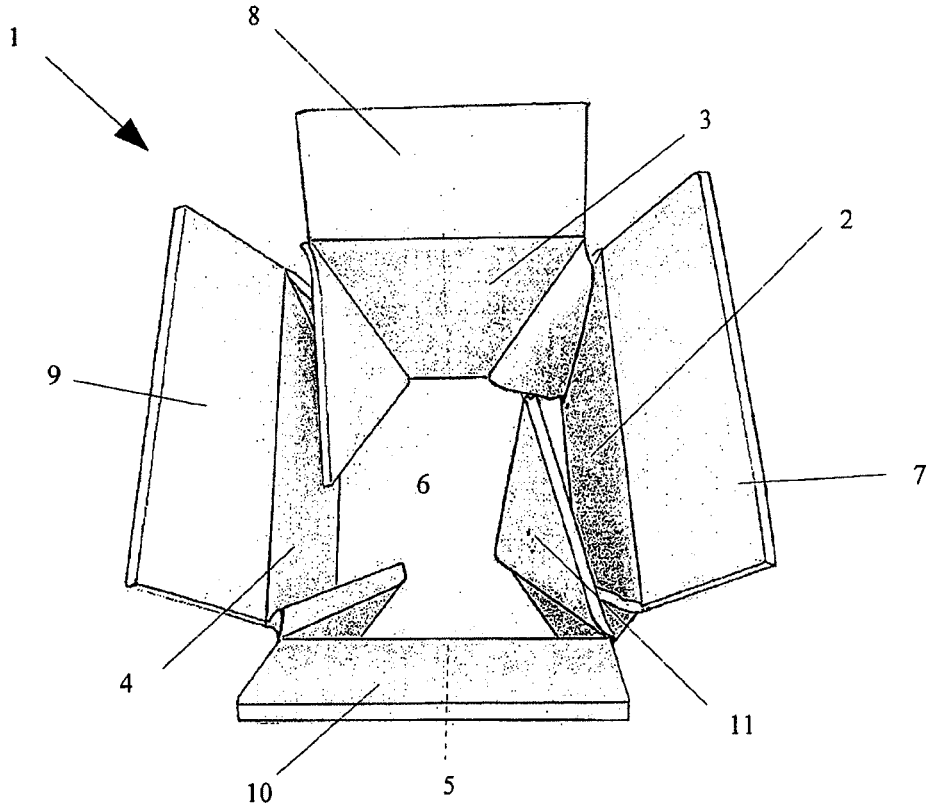
FIG. 1 shows a preferred "block" created according to a preferred embodiment with a locking fold as described in FIG. 2.

As can be seen in FIG. 1, the block 1 is, in a non limiting example, a cube made of four vertical walls 2, 3, 4, 5 (reference hidden under the flap 10), a horizontal base 6 and four flaps 7, 8, 9, 10 created in the continuation of the vertical walls. It can also be seen that "locking folds" 11 have been made at the right angles formed by said walls. (refer to the above procedure).

"Locking fold" means that, in the angles, at least two lateral contact vertical sections are formed at the block cutting edges, which makes it possible to at least double the thickness, which aims at solidifying the places of the block where the weight of the load will be distributed.

"Lateral contact sections" means, in the present application, any vertical section created in the lateral continuation of the vertical walls 2, 3, 4, 5, which can have any shape adapted for guaranteeing a sufficient contact to reach the desired characteristics (as regards solidity, resistance, resilience).

At least two, and preferably four elements 7, 9 of the flap type 7, 8, 9, 10, are created and can be intended to be fixed by any known means to an upper plate element 12 (more particularly glues: wood adhesive, thermofusible glue . . . ; staples, clips, straps, welds (if possible with said material); adhesives etc.). Said flaps 7, 8, 9, 10 are used as contact surfaces between the plate and the block. Preferably an environment-friendly attachment, in other words solvent-free glue, will be used.

Figure 2:
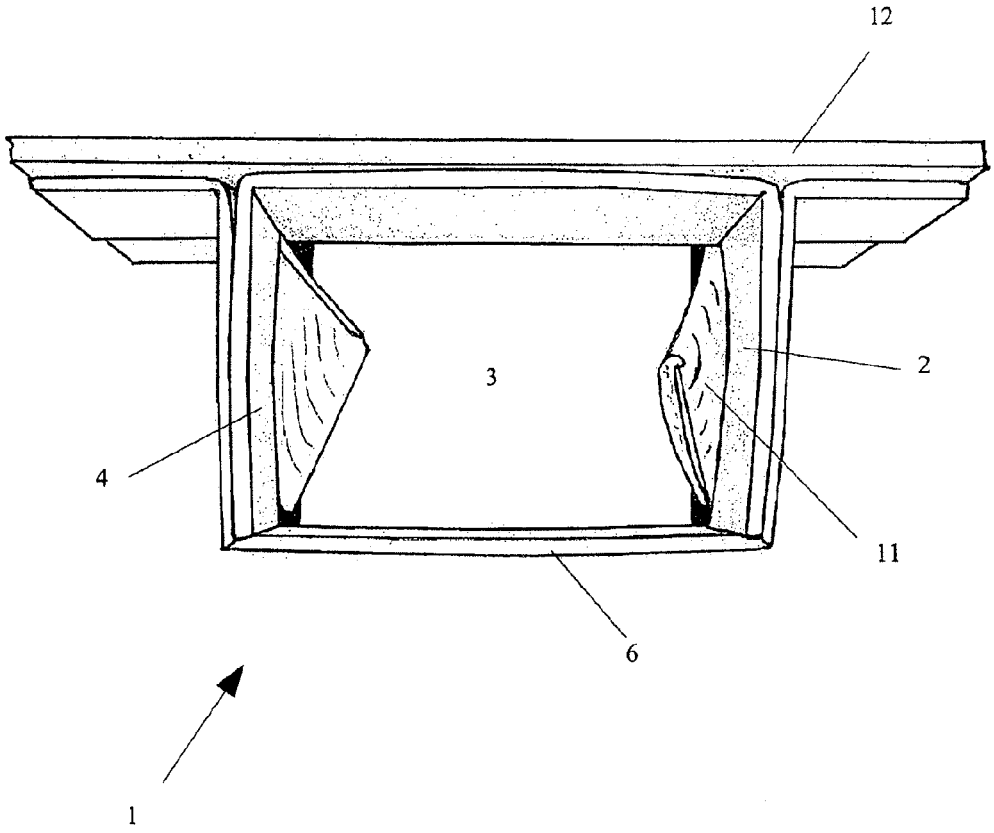
FIG. 2 shows a block fixed on an upper plate.

FIG. 2 thus shows the block 1 fixed to said upper plate 12, whereon the load is to be placed.

According to a preferred embodiment, said block element 1, as well as the locking folds 11 are created from a flat rectangular plate as mentioned in Patent FR 1002482.

The invention is made up of a three-dimensional structure obtained from a flat product, with said flat product being composed of a plate, with the plate including at least two substantially perpendicular edges, with a first lateral fold forming a boundary between a first side and a bottom, on the one hand and a second lateral fold forming a boundary between a second side and the bottom, on the other hand, with the width of the sides being equivalent, and the first and second folds forming a square in the corner of the plate, with the square having two folds along the diagonals thereof, with such folds forming two inner triangles and two outer triangles, with a cut being formed on the fold common to one of the inner triangles and the adjacent outer triangle thereof, with the inner triangles being folded on one another in order to form the three-dimensional structure, with the outer triangle not adjacent to the cut being turned down onto the inner triangle adjacent to the cut in order to lock the three-dimensional structure and to form a preliminary triangular assembly composed of three thicknesses of the flat product and the outer triangle adjacent to the cut.

The invention is also characterized in that the inner triangles are folded towards the inside of the plate.

The sides 3, 4 are folded towards the inside and the bottom 6. When pinching the two inner triangles c, d, in each corner of the tray being mounted, horns are formed in the four corners. The block immediately takes shape. It must then be locked with the outer triangles a, b. Locking is obtained by turning down the outer triangle b onto the inner triangle d. The final shape locking is obtained by turning down the outer triangle a onto the inner triangle c. The material is cut on the line of the common side, between the inner triangle d and the outer triangle a. All the triangles, the sides and the bottom are united in the same plate. Finally, in each corner, all the triangles forming the final assembly 11 are attached by at least one face. The outer triangle a locks the assembly wedged by the cutting edge 60 on one side 3, 4, in other words the side juxtaposed to the triangles of the corner being folded. The block is mounted.

On a rectangular or square plate making it possible to form a block having a bottom and four sides, draw the straight lines defining the height common to the four sides, and intended to delimit the bottom. The height is characterized by the distance between a border (perimeter of the plate) and the closest parallel line. When the four straight lines are drawn, each one is parallel to at least one border of the plate in order to obtain the height of the four sides of the box to be formed, and also making it possible to obtain the perimeter of the bottom of the box, which can be a rectangle or any other similar shape. Such straight lines must be drawn up to the ends of the borders (perimeter) of the plate, which shall be perpendicular to the points of intersection thereof. Each drawn line is thus perpendicular to two other lines to form four equivalent squares in the corners of the plate, which also has right angles. The squares shall be called "locking squares".

In the four squares, draw the two diagonals perpendicular in the center thereof, to form four triangles per square. In each square, the diagonal starting from the bottom of the box, more precisely starting from the right angle of the perimeter of the bottom, shall be called diagonal number one. The second diagonal is the one cutting diagonal number one, in the middle thereof. Make a cut on the second diagonal between the point of intersection with diagonal number one and one of the opposite end points thereof. The second diagonal will thus have a cut on half its length. The symmetry thereof with respect to the point of intersection of the two diagonals shall be shown by a not cut line and by a cut line having an equivalent length.

Then turn up the sides of the block by folding the lines of the perimeter of the bottom so that they are vertical. At the same time, help the lifting in each corner, by pinching both triangles inwards, thus forming the cutting edges of the block. Fold the lines of the sides of the triangles thus forming the cutting edges of the block and fold the side common to the considered two triangles. More precisely, these are the triangles one side of which forms the cutting edges of the block or the height of one side of the block. When both triangles are folded and pinched, one of the faces thereof is attached to the other one. The cutting edges of the four corners of the trays are lifted. The block takes shape. The folding and shaping are as mentioned in the claims.

Then identify in each locking square the third triangle above the first two attached triangles since two triangles are not folded yet. The third triangle can be identified since the second diagonal has not been cut in one of the sides thereof. Fold the line on the side of the third triangle common with the first two triangles. More precisely, the third triangle must be folded onto one of the first two triangles having no side of a triangle in common. Then the three triangles visually form only one triangle with three thicknesses of material. The block is shaped and locked. The folding and shaping are as mentioned in the claims.

The fourth triangle, not folded yet, is connected by only one common side with the third triangle. Fold the line of the common side so as to turn down the surface of the fourth triangle onto the assembly of the three triangles which formed the block. It shall be turned down onto one of the visible faces of the first two triangles and not directly onto one face of the third triangle. In fact, fold the fourth triangle at the line on the side attached to the third triangle. Turn it and fold it onto the free face of the first two attached triangles, more precisely onto the one having no face hidden by the third triangle, since the first or second triangle has no side common with the fourth triangle. The fourth triangle shall then be folded opposite the third one to visually form, together, only one triangle with four thicknesses of material. This operation shall be repeated in each corner of the plate to mount the block.

The block thus created according to patent FR 1002482 includes 4 vertical lateral walls, a horizontal base joining the 4 lateral walls.

The block includes at least a "locking fold" positioned in at least one corner of the block. Preferably, each corner includes a locking fold.

According to the preferred embodiment of the "locking fold" (as indicated in patent FR 1002482), the folding makes it possible to create at least 2 lateral vertical contact sections materialized by at least 2 triangles per corner, preferably three, or even four triangles which, when starting the folding of the block for mounting purposes, make it possible to get the four sides closer to each other, in order to form said open block.

According to said "locking fold" embodiment, glue is not really necessary to build the block.

FIG. 3 illustrates the locking fold embodiment using a flat rectangular plate. Such plate includes at least two vertical walls 4, 3 substantially perpendicular to each other, which are folded laterally with respect to the rest of the plate which shall be the base 6 of the block. Both vertical walls 4, 3 have the same width, in order to create, in the extension thereof, a square zone (in the corner of the plate), composed of at least two triangles, preferably four triangles a, b, c, d which are formed by the diagonals of said square zone. According to the non limiting example of FIG. 3, cuts shall be made on the line formed between the triangles a and d, then the triangles c and d shall be folded toward the inside of the plate 6 (triangles c and d will thus form only one triangle with a double thickness). The triangle b is turned down onto the double triangle c, d in order to form a triple triangle, and eventually the triangle a will be turned down onto the triple triangle. The fold thus created is the "locking fold" 11. This embodiment makes it possible to create at least three thicknesses (in this event, 4 thicknesses) at the cutting edge 60.

The same procedure can be used between the walls 2 and 3, 4 and 5 and 5 and 2 in order to execute 4 locking folds 11 in each one of the corners of the block 1.

According to other embodiments, the triangle a can be cut and removed in order to create only 3 triangles, which, after folding, will form the triple thickness, as per the same procedure.

In addition to triangle a, the triangle b can also be removed, and thus a double thickness will be obtained.

Of course only two triangles c, d can be created with only one diagonal in the square zone.

As mentioned above, one of the interesting points lies in that the "locking fold" 11 used creates, in fact, at least two vertical contact surfaces (in the non limiting event of a cube having a square or rectangular cross-section) which double the thickness of the material used at the points where the weight of the load will be distributed. In addition, the fact that no glue, or little glue, or staples or other conventional attachment means are used gains elasticity and a shock absorption which also improves the desired characteristics of solidity.

According to another embodiment, the creation of two triangles only formed by one diagonal in the square zone can be used. This, of course, will entail losses in quality and in the desired characteristics of solidity and flexibility.

According to another preferred embodiment, an alternative block can be created as can be seen in FIG. 4. FIG. 4*a* shows the pre-cut flat plate having the particularity of being provided with tab elements 13, 14, 15*a*, 15*b*, 16*a*, 16*b* preferably positioned in the continuation of the flap elements 9, of the walls 2, 4. The tabs 13 and 14 are respectively placed at the centre of the flaps 9 and 7, whereas the tabs 15*a*, 15*b* are positioned on either side of the tab 13; with the tabs 16*a*, 16*b* being positioned on either side of the tab 14.

The tabs 13 and 14 have the same length as the walls 4 and 7, so that, when folded, such tabs 13 and come into contact with the base 6 of the block. This gives an increased solidity to the assembly, with a "reinforcing" function.

The tabs 15*a*, 15*b*, 16*a*, 16*b* are smaller in size that the tabs 13, 14, but the four tabs have the same length and the same width. They are adapted to the width of the holes 17*a*, 17*b*, 18*a*, 18*b* created on the flaps 8, 10 of the walls 3, 5. The tabs 15*a*, 15*b*, 16*a*, 16*b* can thus go through the holes preferably positioned and obstruct the assembly when folded in order to avoid any type of motion. The tab 15*a* will go through the hole 18*a*, the tab 15*b* will go through the hole 17*a*, the tab 16*a* will go through the hole 17*b* and eventually the tab 16*b* will go through the hole 18*b*.

The block thus created will no longer be able to disassemble (refer to FIG. 4). The folding of the block is adapted so that the tabs 13 and 14 are positioned between added elements 19, 35 (having dimensions identical with those of the walls 8, 10) which shall be separated just enough to let the tabs 13 and 14 go therethrough.

Elements 36, 37 having dimensions equal to those of the elements 8, 10, are also used for giving even more stability and reinforcement to the block.

The thus created assembly will not be able to move since all the elements are adapted to block one another.

The Figure shows the locking fold 11 with two lateral contact sections 20, 21 as shown in FIG. 5 (herein under).

Such alternative block can of course include the locking fold system 11 as described in FIG. 3 or any other locking fold system 11 forming at least two thicknesses at the cutting edge (refer to FIG. 14).

Such alternative block is interesting, from the beginning, in all the elements aiming at providing a maximum solidity, without having to create different reinforcing elements. However, said block can be provided with one outer reinforcing element, if this is demanded by a person skilled in the art.

The alternative block can be glued on a floor, using glue or an adhesive foil and can be recycled, thus locking the system and uniting it once and for all.

FIG. 5 shows a block being folded with the creation of a locking fold at two lateral contact sections 20, 21 which are glued or attached together by any known means.

FIG. 6 shows still another block according to a less preferred embodiment.

FIG. 7 thus shows in a non limiting example a reinforcing element 30 at the centre of a block 1 which obstructs and prevents the locking folds from moving. The locking folds are held in position thanks to this reinforcing element. In addition, there is no clearance left between all the elements in order to make the block or the side-member totally rigid in order to absorb the side shocks.

FIG. 8 shows non limiting examples of inner reinforcing elements 30 or 31 provided for being positioned inside the block 1.

Such inner reinforcing element 30 or 31 is also so arranged as to bring some additional resistance to the pressures which shall be exerted thereon, and thus more solidity to the load support assembly. Such inner reinforcing element shall be positioned in the empty space, in the middle of the block element 1.

Such inner reinforcing element can be an element of the brace, oval, zigzag types, or rods, tubes etc. elements. It shall be made up of any element capable of guaranteeing an additional, horizontal as well as vertical, solidity, a material of the cardboard type (the same one as the one used for the block type elements), or any other material accessible to the person skilled in the art.

The brace composed of cardboard squares positioned vertically in the grooves and interleaved in braces generates a significant capacity of resistance to the load distribution, thus reinforcing the double thickness.

The inner reinforcing element 30 or 31 thus strengthens both the distribution of loads from top to bottom, preferably and also the lateral ones, in case a shock occurs on the block or the side-member. The shock energy will go through the wall in order to dissipate in the reinforcing part and then in the whole block, thus preventing the deformation and the destruction of the block itself.

Of course other examples of inner reinforcing elements easily accessible to the persons skilled in the art can be provided.

In one particular embodiment, an outer reinforcing element 40 can be provided to be positioned, for example, about the vertical walls 2, 3, 4, 5 in order to bring even more solidity and reinforcement to the block 1. This can be particularly useful in the event a mishandling is executed which could damage the block element. This will also be an additional element enabling to lock the position of the locking folds (with at least a double thickness).

In a preferred embodiment, such outer reinforcing element 40 shall be a "belt" element, totally surrounding the "block" element (Refer to FIG. 9).

Such "belt" element doubles the thickness of the walls 2, 3, 4, 5 of the block and significantly increases the capacity of load distribution and reinforces solidity against the perforation by a cutting tool like the forks of a fork lift truck.

In one preferred embodiment, is also added an additional reinforcing locking wedge element 50 (Refer to FIG. 10). Such element 50 is made up of the same material as the one used for the other elements making up the load support device. Such element includes a base 51 and four portions 52, 53, 54, 55 adapted to strengthen and lock the "locking fold" position 11. As a matter of fact, the 4 portions are pushed apart from one another, respectively in order to let the "locking folds" go therethrough.

The portions 52, 53, 54, 55 of this locking wedge 50 slide against the four vertical walls 2, 3, 4, 5 of the block, inside, and against the "locking folds" 11, thus preventing them to unlock and preventing the inclination or the buckling of the vertical walls of the block 1. When the locking wedge is positioned, the base of the wedge 51 can come into contact with the inner reinforcing element 30 or 31, if the latter is used.

The portions 52, 53, 54, 55 thus double the capacity of load distribution as compared to single walls. The portions can also increase the resistance of the outer walls of the block to side shocks, thus preventing untimely smashing or perforation by the forks of a fork lift truck, for instance.

In the event where an inner reinforcing element 30 or 31 is used, the latter is adapted for leaving just enough space for inserting the locking wedge 50.

The top of the base of the locking wedge 50 comes directly in contact with the underside of the plate 12, thus significantly increasing the block gluing and holding contacts. The four flaps 7, 8, 9, 10 and the contact surface of the locking wedge result in the block 1 being fixed and no longer exposed to shearing.

In fact, the walls of the block are doubled thanks to the locking wedge, which significantly increases the resistance of the walls to buckling.

The use of solvent-free, environment-friendly and recycled glue in packing is limited to fixing the upper surface of the locking wedge and the flaps against the underside of the upper plate 12. Afterwards, the whole system with or without the locking wedge 50 is permanently enclosed, thus creating a compact and rigid assembly.

The present invention creates a block which executes a buckling phenomenon towards the outside of the block. Such outward buckling is resilience, as a horizontal metal bar receiving a load gets buckled when a load is violently placed thereon. The deformation will store the shock energy and return to its initial shape when the impact is over. The situation is the same for double thickness blocks. On the contrary, the rigidity of a single wall, in the corner, would have burst the volume, with the energy not being absorbed by any significant deformation on only one thickness. In the event of two triangles glued in one corner, forming two contact surfaces, the thicknesses are also used as dampers and will unglue to buckle. Then they will return to their position, with the help of the reinforcing element and the locking wedge, if any.

As can be seen in FIG. 15, and in a non limiting way, the locking folds can come into contact with the upper portion of the block, or with the upper plate, in order to absorb a part of the weight of the load which shall be placed thereon.

According to a preferred embodiment, and with a view to creating an efficient load support device, several block elements 1 will be fixed to one upper plate 12 (Refer to FIGS. 12 and 13).

The discrepancies between said blocks shall be studied to give an optimum distribution of the weight of the load which will be placed thereon. Such discrepancies are also adapted to enable an easy handling of the load support devices by handling tools, etc.

According to a preferred embodiment, a block will have the following dimensions (non limiting):

130×100×90 mm,
100×100×90 mm,
200×100×90 mm.

The volumes can have preferably narrow shapes in order to form side-members along the length or the width of the pallet, and have the preferred dimension of 1150×100×90 mm. On a 1200×800 mm, or 1200×1000 mm pallet, for example, three side-members are provided.

The height can also vary and be, preferably 100 mm. In fact, the present invention is of course not limited, as boxes are, since the locking folds can be cut and locked by gluing means, inner reinforcing elements, locking wedges as well as outer reinforcing elements. Many industrial tests have been conclusively carried out with these dimensions and the pallets are perfectly operative. They have been used several times.

For this purpose, tests have been carried out with double micro wall, or triple wall corrugated board provided with reinforcing wedges and locking wedges, without using the outer reinforcing element. A load weighing 1,980 kg could be placed on only four blocks.

The blocks are not buckled or destroyed. They played their part as supports.

Using more resistant cardboards like double wall corrugated board and heavier paper weight, the Applicant reached 600 kg of load distribution on the same block volume. Many tests have also been executed on pallets, in the industrial and logistics fields. The pallets show the same resistance as wooden ones.

Depending on the quality of the cardboards used, each block can at least resist a 600 kg load distribution, or even much more. Standard pallets, which are 1200×800 mm, 1200×1000 or 1150×1150 in dimensions, preferably having 9 blocks can support uniformly distributed 5,400 kg loads. Among others, the reinforcing wedge is made of triple wall corrugated board, with high density and good "kraft" quality paper sheets. Other cardboard qualities can be used to reach the same result.

The resistance of the upper plate is of course adapted to the load to be supported.

Depending on the quality of the cardboard used, the bases of the blocks are watertight, thanks to the characteristics of the locking folds. Since they have no cut in the corner, thanks to the reconciliation of the first two triangles and depending on the configuration, the blocks will not let moisture in. A block like the one shown in FIG. 6 shall soon be exposed to water projections, since the material has been cut. Moisture-resistant cardboard makes it possible to store pallets according to the invention outdoors.

A cardboard pallet weighs approximately between 2 and 5 kg.

For information, and as a non limiting example, and for a preferred dimension of the block of 130 mm in length, 100 m in width and 90 mm in height, the following characteristics will be obtained:

As for the block cardboard envelope itself:

the block 1 can be made up of a double or single wall corrugated board, or triple wall corrugated board like solid fiberboard. The thickness of the sheet can be from 2 to 7 mm. But greater thicknesses can be considered.

As for the reinforcing element 30, 31, preferably a brace:

the reinforcing element 30, 31 can be made up of single, double or triple wall corrugated board or solid fiberboard. Depending on the required load distribution resistance and economic constraints, thickness is scalable ranging from 2 mm to 20 mm.

As for the locking wedge 50, with four flaps:

the thickness is scalable, depending on the cardboard sheet which can be a single, double or triple wall corrugated board, or even thick solid fiberboard. The thickness of the locking wedge can preferably be between 4 mm and 10 mm.

As for the outer reinforcing element 40:

this is a cardboard sheet which can preferably be a single or double wall corrugated board or solid fiberboard. The thickness can be between 4 and 10 mm. A triple wall corrugated board can be used.

The materials used can of course be of any type: similar to cardboard, like PP bubble pack; plastic plates or event metal sheets.

Double wall corrugated board, single wall corrugated board, triple wall corrugated cardboard, solid fiberboard, single or double micro wall corrugated board can preferably be used. Mixed qualities such as for example a block made of single wall corrugated board, in which a reinforcing element made of triple wall corrugated board is inserted, and a locking wedge composed of a double wall corrugated board locks the block. Then the block can be reinforced with an outer reinforcing element made of single or double micro wall corrugated board, or triple wall corrugated board, or any other material easily accessible to the person skilled in the art.

The blocks can be glued anywhere on the whole surface of the upper plate. Pallets of any dimensions and containers of any dimensions can be produced, with blocks glued on the underside, according to the invention.

The grooves will preferably be vertical in order to enhance the load distribution phenomenon (in other words the distribution of weight).

Recycled cardboard can also be used. As the block requires a small quantity of material, used packings can be collected and cut with a punch as per the required dimensions, in large enough surfaces.

In order to even more significantly improve the solidity of the block or the side-member, gluing all the mentioned elements together can be considered, as the inner reinforcing element is glued on the bottom. The locking wedge is glued with the inner walls of the block. Or the triangles can be glued together, and the elements can all be connected by the gluing means, preferably using solvent-free glue, of the wood adhesive type. The block reaches indestructible characteristics. But it can still be recycled, with solvent-free glue, and be discarded in a cardboard bin and crushed. Solvent-free wooden adhesive can be recycled with cardboard and also is uninflammable.

The upper plate can be made of the same material as the one used for the production of block, but can also be produced from any other material, according to the general knowledge of the person skilled in the art.

The invention also covers all the embodiments and all the applications which shall be directly accessible to the persons skilled in the art upon reading the present application, and his/her own knowledge.

For example, blocks, and more particularly long narrow blocks can be produced as side-members. In the case of side-members, the reinforcing elements, the locking wedges and the belts will easily be adapted thereon, accordingly.

Podiums, steps, stools, tables, bed bases, cardboard pieces of furniture etc. . . . can also be manufactured, and more generally any element used as a "load support" device.

Of course, accessory blocks for lateral wedging between pallets during transportation in trucks, sea freight containers, or the like can be considered. Logisticians use plastic bags, often filled with polystyrene particles. As cardboard blocks have damping properties, they can be fixed on the side walls of the pallets or against the walls of the trailer.

The invention claimed is:

1. A load support device of cardboard material, said load support device comprising:

at least one block element comprising a polygonal shape, at least two vertical walls, a horizontal base, an upper load receiving surface, and at least one locking fold arranged in at least one corner of the block element;

said locking fold being formed by at least two lateral vertical contact sections of said block element such that said block element, in an area of the locking fold, provides load support;

a reinforcing locking wedge element made of a same material as said at least one block element and comprising a base and four portions; and at least one of said four portions being structured and arranged to strengthen and lock a position of the at least one locking fold.

2. The load support device of claim 1, wherein the locking fold comprises a material thickness that is doubled that of a material thickness of at least one of said at least two vertical walls, wherein the reinforcing locking wedge element is insertable into an upper open end of said block element, wherein the four portions of the reinforcing locking wedge element comprise open corner sections and at least one said open corner sections receives therein sad at least one locking fold.

3. The load support device of claim 1, wherein the at least two vertical walls comprises four vertical walls.

4. The load support device of claim 1, wherein the polygonal shape is one of:

substantially square;

substantially rectangular;

octagonal; and triangular.

5. The load support device of claim 1, wherein the locking fold is integrally formed with the at least two vertical walls.

6. The load support device of claim 1, wherein the at least two lateral vertical contact sections at least one of:

glued to one another; and fixed to one another.

7. The load support device of claim 1, wherein one of:

the at least two lateral vertical contact sections said locking fold comprise two triangle shaped sections;

the at least two lateral vertical contact sections said locking fold comprise two triangle shaped sections folded with respect to one another about a score line;

the at least two lateral vertical contact sections said locking fold comprise plural polygonal shaped sections folded with respect to one another about plural score lines;

the at least two lateral vertical contact sections said locking fold comprise four triangle shaped sections folded with respect to one another about plural score lines so as to form a triangular-shaped locking fold.

8. The load support device of claim 1, wherein one of:

said at least one block element comprises a folded arrangement of a pre-cut flat cardboard material which includes tab sections that form an upper cover for said at least one block element and securing tabs extending from at least one of the tab sections sized and configured to extend into openings formed in at least another of said tab sections; and said at least one block element comprises a folded arrangement of a pre-cut flat cardboard material which includes four tab sections that form an upper cover for said at least one block element and securing tabs extending from two of the four tab sections which are sized and configured to extend into openings formed in two other of said four tab sections.

9. The load support device of claim 1, wherein one of:

said at least one block element comprises a folded arrangement of a pre-cut flat cardboard material which includes tab sections that form an upper cover for said at least one block element and securing tabs extending from some of the tab sections which are sized and configured to extend into openings formed in some other of said tab sections, and wherein said securing tabs one of:

have a same length as the at least two vertical walls; and extend onto said block element and to the horizontal base; and said at least one block element comprises a folded arrangement of a pre-cut flat cardboard material which includes tab sections that form an upper cover for said at least one block element and securing tabs extending from some of the tab sections which are sized and configured to extend into openings formed in some other of said tab sections, and wherein said securing tabs one of:

have a width that is narrower that a width of one of said tab sections; and are of different lengths.

10. The load support device of claim 1, further comprising one of:

a reinforcing element positioned within a main central internal space of said block element; and a reinforcing element positioned outside said block element and having walls arranged adjacent vertical walls of said block element, said reinforcing element comprises a belt-shaped member that surrounds the vertical walls of said block element.

11. The load support device of claim 1, wherein one of:

the four portions of the reinforcing locking wedge element provide load support and are each located adjacent one of the vertical walls of said block element; and the at least one locking fold extends to an upper portion of said block element and functions to provide load support.

12. The load support device of claim 1, wherein said block element is fixed to an upper plate element and said upper plate element comprises dimensions that are one of:

1200×800 mm;

1200×1000 mm; and

1150×1150 mm.

13. The load support device of claim 1, wherein said block element comprises dimensions that are one of:

130×100×90 mm;

100×100×90 mm; and

200×100×90 mm.

14. The load support device of claim 1, wherein the cardboard material is one of:

a single wall corrugated material;

a double wall corrugated material;

a triple wall corrugated material; and a solid fiberboard material; and a thickness of between 2 and 7 mm.

15. The load support device of claim 1, further comprising a reinforcing element positioned within a main central internal space of said block element and comprising one of:

a corrugated board material;

a solid fiberboard material; and a material thickness ranging from 2 mm to 20 mm.

16. The load support device of claim 1, wherein the reinforcing locking wedge element comprises one of:

a corrugated board material;

a solid fiberboard material; and a material thickness ranging from 4 mm to 10 mm.

17. The load support device of claim 1, further comprising a reinforcing element positioned outside said block element and having walls arranged adjacent vertical walls said block element and said reinforcing element comprises one of:

a corrugated board material;

a solid fiberboard material; and a material thickness ranging from 4 mm to 10 mm.

18. The load support device of claim 1, wherein said block element is a watertight structure.

19. A load support device of cardboard material, said load support device comprising:

at least one block element comprising a polygonal shape, vertical walls, a horizontal base, an upper load receiving surface, and plural locking corner sections formed from folded-in portions of the vertical walls;

the vertical walls comprising two pairs of oppositely arranged parallel vertical walls;

each locking corner section functioning as a reinforcement;

at least one reinforcing element made of a cardboard material and providing additional load support to said at least one block element; and said at least one reinforcing element comprising plural vertical walls and being arranged one of:

inside the at least one block element; and outside the at least one block element.

20. A load support device of cardboard material, said load support device comprising:

at least one block element comprising a polygonal shape, vertical load supporting sidewalls, a horizontal base, an upper load receiving surface, and plural locking corner sections formed from folded in portions of the vertical sidewalls;

each locking corner section functioning as a reinforcement and being at least one of:

triangular in shape; and retained in a locked position;

at least one a reinforcing element made of a cardboard material and providing additional load support to said at least one block element; and said at least one reinforcing element comprising plural vertical load supporting walls.

* * * * *